US005271175A

United States Patent [19]

West, III

[11] Patent Number: 5,271,175

[45] Date of Patent: Dec. 21, 1993

[54] SHOOTER'S BENCH

[76] Inventor: David T. West, III, 1925 Maple Wood Dr., Hagerstown, Md. 21740

[21] Appl. No.: 981,065

[22] Filed: Nov. 24, 1992

[51] Int. Cl.[5] ..... F41A 23/02

[52] U.S. Cl. ..... 42/94; 89/37.04; 297/170

[58] Field of Search ..... 42/94; 89/37.04; 108/155, 111, 103, 101; 297/135, 172, 170

[56] References Cited

U.S. PATENT DOCUMENTS

| | | | |
|---|---|---|---|
| 2,722,965 | 11/1955 | Chapman et al. | 297/170 |
| 3,125,929 | 3/1964 | Peasley | 297/135 |
| 3,711,984 | 1/1973 | Dyer et al. | 42/94 |
| 4,501,082 | 2/1985 | Phillips et al. | 42/94 |
| 4,506,466 | 3/1985 | Hall | 42/94 |
| 4,535,559 | 8/1985 | Hall | 42/94 |
| 4,565,403 | 1/1986 | Brown | 297/3 |
| 4,697,778 | 10/1987 | Harashima | 108/103 |
| 5,060,410 | 10/1991 | Mueller | 42/94 |
| 5,067,268 | 11/1991 | Ransom | 42/94 |
| 5,080,322 | 1/1992 | Harley | 108/103 |
| 5,149,900 | 9/1992 | Buck | 42/94 |
| 5,173,563 | 12/1992 | Gray | 42/94 |

FOREIGN PATENT DOCUMENTS 318340 7/1917 Fed. Rep. of Germany .

*Primary Examiner*—David H. Brown
*Attorney, Agent, or Firm*—Dowell & Dowell

[57] ABSTRACT

A portable bench for stabilizing firearms when shooting which includes a stand consisting of a base plate and a plurality of outwardly extending legs. An inclined forearm rest and a seat are mounted to one side of the stand and a firearm support is rotatably secured to the base plate.

16 Claims, 2 Drawing Sheets

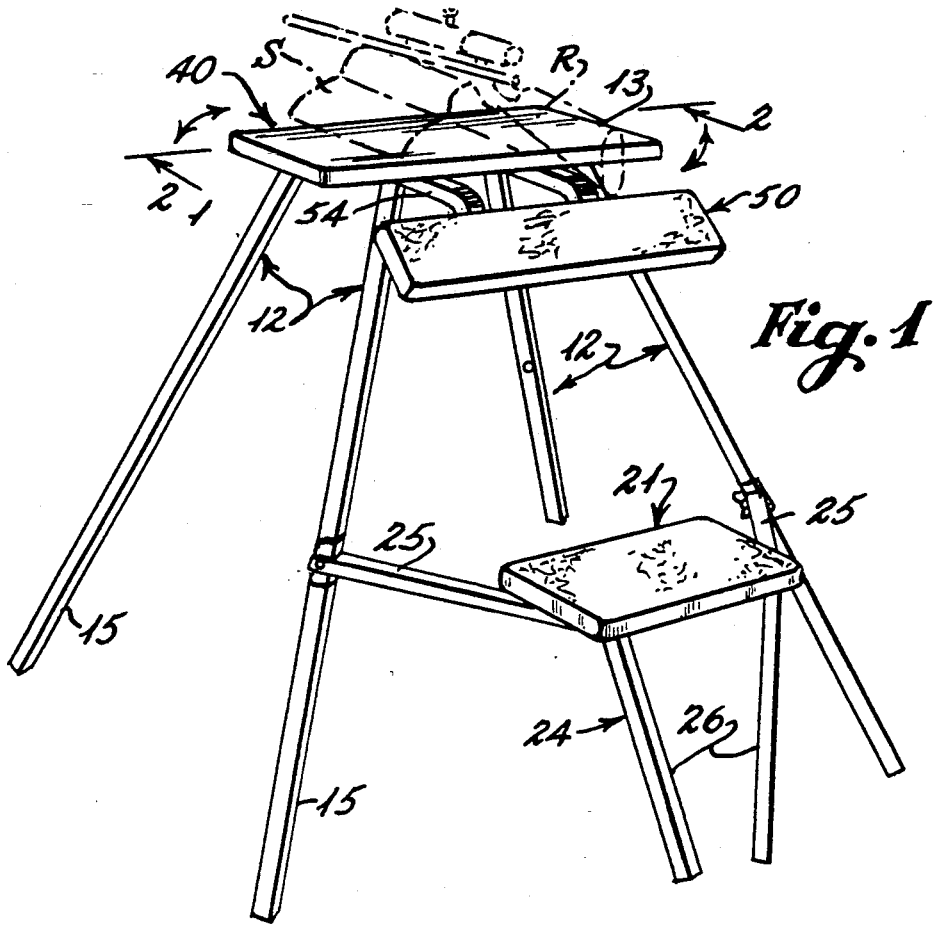
Fig. 1
Fig. 2
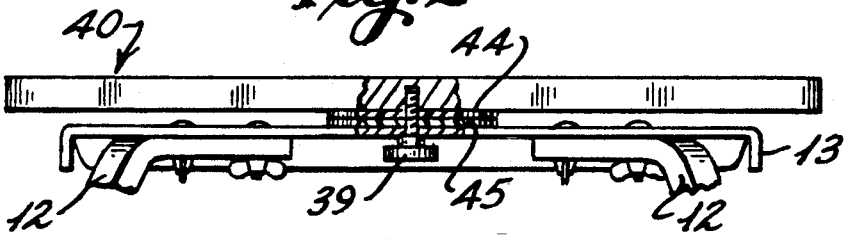
Fig. 4
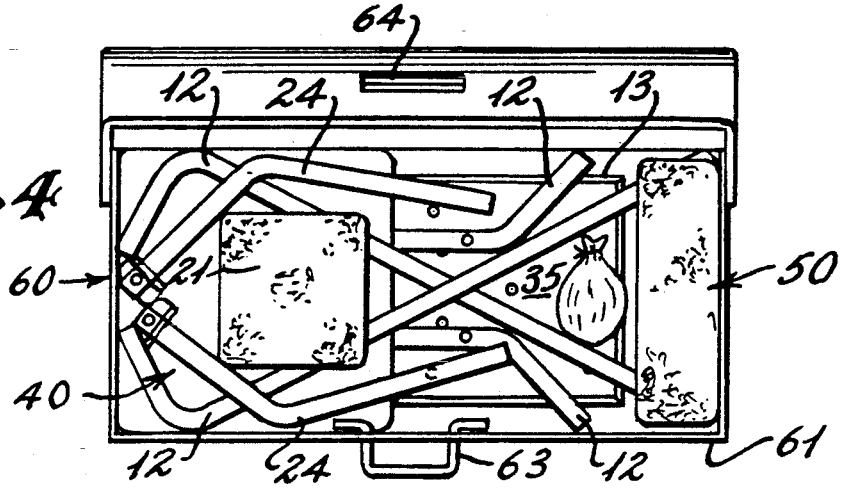

SHOOTER'S BENCH

BACKGROUND OF THE INVENTION

1. Field of the Invention

This invention is generally directed to benches used to stabilize firearms for purposes of sight alignment, target shooting, or hunting. More specifically, the invention is directed to a portable shooter's bench which includes a stand from which extend a forearm rest and a seat for supporting an individual in a natural and relaxed position. A firearm support platform is rotatably mounted to a base plate forming the upper portion of the stand so that windage adjustments may be made by slight rotation of the platform. The forearm rest is inclined relative to the firearm support platform and provides for the hand and wrist alignment and stability necessary for precision shooting and marksmanship.

The invention is further directed to shooters' benches of the type set forth above which are completely assembled and disassembled without the use of tools and in which the components thereof are easily stored and carried within a convenient case.

2. History of the Related Art

It is well-known that the accuracy of a firearm, such as a rifle or pistol, is determined by the stability of the firearm when in use. Consistent accuracy is extremely difficult to achieve when a firearm is manually supported and, it is almost impossible under such conditions for an individual to hold a firearm steady enough during its use to obtain optimum accuracy, especially at long ranges. Therefore, supports or benches have been used to eliminate human error in sighting or aiming firearms in the sports of target shooting and hunting. The most basic benches utilized to assist marksmen and hunters generally include a table upon which the firearm may be steadied and a stool or seat upon which the individual may be seated. With most conventional shooters' benches, the shooter is seated on the stool with their forearms extending across the surface of the table or bench. The firearm is steadied either by the use of brackets extending upwardly adjacent each side of the stock or by the use of sandbags which are deformable to cradle or support the stock. One such bench which incorporates a support for the firearm and a separate adjustable stool is disclosed in U.S. Pat. No. 4,535,559 to Hall. Although such a bench gives support to the individual's arms and thus provides some degree of stabilization of the shooter's body relative to the firearm, the natural positioning of the individual's forearms, hands and wrists is not established and therefore the bench is somewhat awkward to utilize. Another type of portable shooter's bench which provides support for a shooter's arms and for a firearm, but which does not include an attached seat for supporting the shooter, is disclosed in U.S. Pat. No. 4,501,082 to Phillips et al. Again, with such a bench, there has been no provision made for allowing the body of the individual to be properly supported to account for the natural extension of their shooting hand, wrist and forearm during use of a firearm.

Other types of shooters' benches have been designed which are portable and which include seat components which are secured directly thereto. Examples of such structures are disclosed in U.S. Pat. Nos. 3,711,984 to Dyer et al., 4,506,466 to Hall, 4,565,403 to Brown and 5,060,410 to Mueller. Although each of these patents disclose portable benches for stabilizing firearms which include seats secured to the benches, there has been no provision made for supporting an individual's wrist and forearm which must be comfortably stabilized to insure optimum and continuous accuracy, especially when firing at long distance targets.

Some of the shooters' benches discussed above have also been designed to facilitate their portability and are easily assembled and/or disassembled and stored in cases for transportation. However, although there has been a great deal of inventive effort directed to improving the handling and storage of shooters' benches and, despite the improvements made in the prior art, such devices have not fully appreciated the need to provide for maximum arm and wrist support and overall user comfort to obtain optimum conditions for sighting and using firing firearms.

Additional examples of shooters' benches and seat and table combinations are disclosed in U.S. Pat. Nos. 2,722,965 to Chapman et al. and 5,067,268 to Ransom and German patent 318,340 dated Jul. 11, 1917.

SUMMARY OF THE INVENTION

This invention is directed to a lightweight and portable shooter's bench designed to provide optimum support and user comfort to increase accuracy in the use of a firearm and which includes a stand having a plurality of legs that support a base plate in spaced relationship from the ground. The legs are designed to extend generally outwardly relative to the base plate so as to provide maximum support and stability for the stand. A seat is attached and cantilevered outwardly between two adjacent legs of the stand with the seat being further supported by leg members which extend therefrom at a point spaced outwardly from the primary legs of the stand and thereby provide additional stability.

The shooter's bench of the present invention further includes an inclined forearm support which is mounted to the base plate and spaced above the seat. The forearm support is further spaced inwardly of the seat relative to the center of the stand so that an individual positioned on the seat will be inclined slightly forwardly with their forearm resting against the forearm support when the bench is in use. A firearm support table is mounted to the upper surface of the base plate of the stand and is preferably rotatably mounted thereto to allow for windage adjustments in a horizontal plane. Bearing elements are provided intermediate the table and the base plate which may be tensioned so as to retain the table in an adjusted position with respect to the base plate.

In one embodiment, the upper surface of the table is designed to be somewhat rough in order to restrict any movement of devices such as sandbags which may be placed thereon to provide deformable cradles for stabilizing a firearm.

The components of the invention are designed to be assembled utilizing hand manipulated fasteners so that the benches may be assembled and disassembled without tools. Further, the components are sized to be conveniently placed within a carrying case for storage or transportation. To facilitate further anchorage of the bench in ground surface areas, the legs of the stand, and those which support the seat, may be constructed of open tubular stock material so that the lower ends thereof will cut into the ground when weight is applied to the bench.

It is a primary object of the present invention to provide a shooter's bench which provides support for an individual's shooting wrist and forearm when the individual is positional on the seat of the bench so that any tendency to move the forearm during shooting is essentially eliminated.

It is another object of the present invention to provide a portable shooter's bench which is lightweight and assemblable without the use of tools thereby allowing the bench to be carried into remote locations so that the bench may be utilized for hunting and varmint destruction.

It is a further object of the present invention to provide a portable shooter's bench which includes a cantilevered seat having legs which provide additional stability to the bench especially when the shooter is seated.

It is also an object of the present invention to provide a portable shooter's bench wherein the support for a firearm is selectively rotatable so as to allow for windage adjustments with minimum effort.

BRIEF DESCRIPTION OF THE DRAWINGS

FIG. 1 is a front perspective view showing in dotted line the positioning of a firearm relative to the firearm support table of the present invention.

FIG. 2 is an enlarged cross-sectional view taken along lines 2—2 of FIG. 1 showing the relationship between the firearm support table and the base plate of the stand of the assembly.

FIG. 4 is a top plan view of the shooter's bench of the present invention being disassembled and packaged within a portable carrying case.

DESCRIPTION OF THE PREFERRED EMBODIMENT

Figure 3:
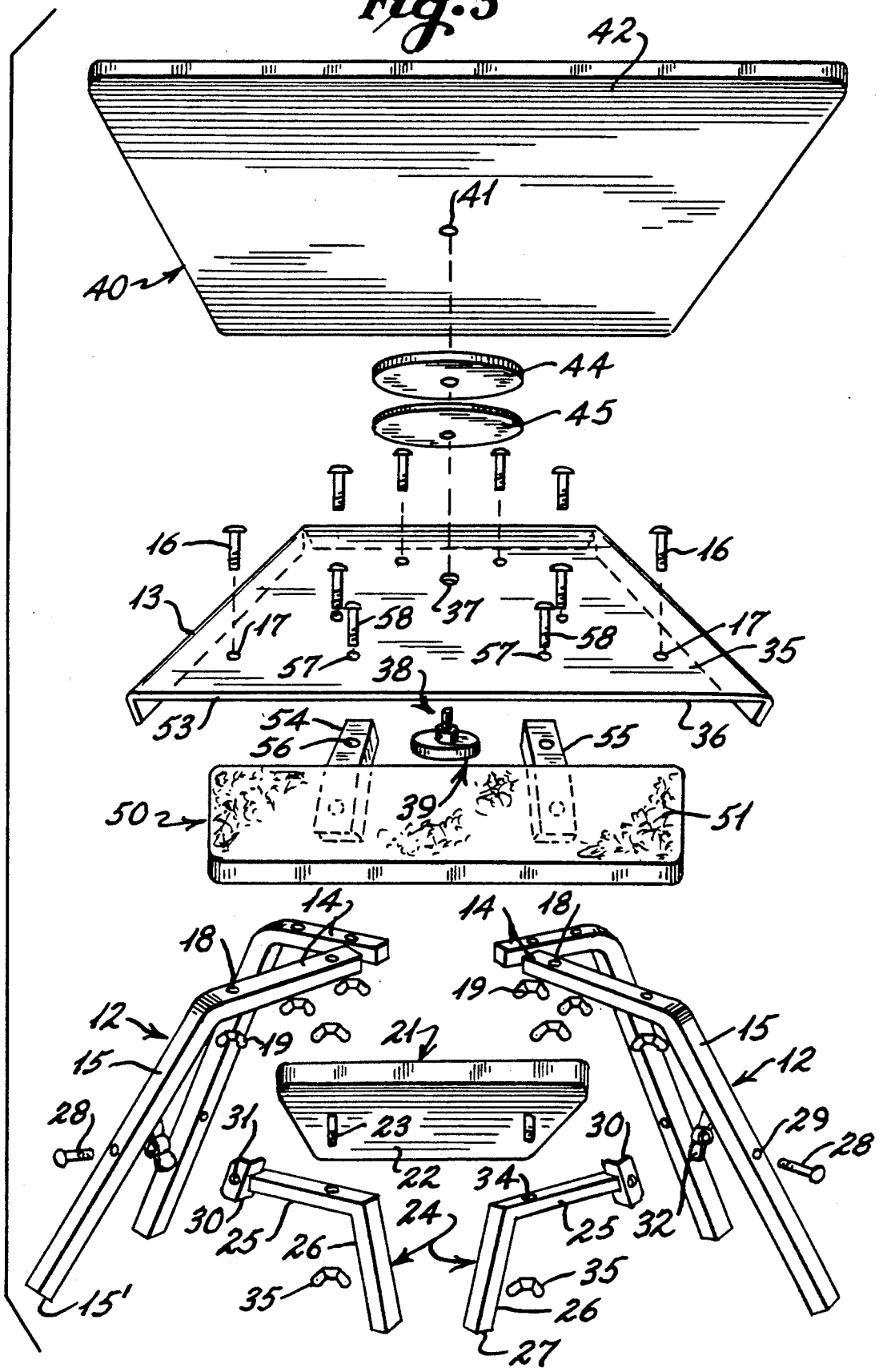
FIG. 3 is an enlarged assembly view of the shooter's bench of the present invention.

With continued reference to the drawings, the shooter's bench 10 of the present invention includes a stand 11 including a plurality of primary legs 12 and a base plate 13. Each leg 12 includes an upper portion 14 which is generally horizontally oriented and a lower outwardly tapering portion 15. Each leg is preferably formed of a tubular metallic material and is open at the lower end 15' thereof so that the legs will engage and dig into the ground when the bench is erected. Each leg 12 is connected by a plurality of bolts 16 which extend through aligned openings 17 in the base plate and 18 in the upper portion 14 of the legs and which are secured utilizing wing nuts 19. In the embodiment shown, two pair of such fastening elements 16 and 19 are utilized to secure each leg to the base plate. Although not shown in the drawing figures, it is contemplated that the outwardly extending lower leg portions 15 may include inner telescoping members which would allow the legs to be adjusted for height variations.

In order to support a shooter, a detachable seat 20 is provided which includes an upper padded surface 21. A pair of threaded pins 23 extend downwardly from the seat. The seat 20 is supported by a pair of angled legs 24. Each of the seat support legs includes a generally horizontally upper segment 25 and a depending segment 26. The legs are formed of tubular metal stock and the lowermost ends 27 are open, as is the case with the ends 15' of the primary legs of the base, to allow the legs to dig into the ground especially when the shooter is positioned on the seat 20. The seat support legs 24 are secured between a pair of opposing primary legs 12 by the use of manually operable fastening elements including bolts 28 which extend through openings 29 in the lower portions 15 of the legs 12 and through an opening 31 in a bracket 30 welded to the innermost portion of the leg segment 25. The bolts 28 are secured utilizing wing nuts 32. To permit the seat to be secured to any pair of adjacent primary legs, each of the primary legs includes a centralized opening 29 for selectively receiving the bolts 28 therethrough. The seat is secured to the seat support legs 24 by inserting the threaded pins 23 through openings 34 provided along the upper segments 25 thereof. The pins 23 are thereafter secured utilizing wing nuts or similar manually operable fasteners 35.

With specific reference to FIG. 1, the seat is positioned outwardly with respect to the adjacent legs 12 so that when the shooter is seated thereon, the weight of the shooter will anchor the primary legs 12 and the seat support legs 24 uniformly, thereby providing increased stabilization for the bench.

The base plate 13 of the stand 11 includes an upper surface 35 and lower surface 36. An opening 37 is provided through the base plate for purposes of allowing a threaded fastening element 38 to be extended upwardly therethrough. The fastening element is carried by a hand engageable handle 39.

To provide stabilization for a firearm R, a firearm support table 40 is mounted to the upper surface 35 of the base plate. The table 40 includes a threaded recess 41 in the lower surface 42 thereof for receiving the threaded fastening element 38. In some instances, a separate threaded sleeve (not shown) may be inserted within an opening provided in the central portion of the table 40. The opening 37 through the base plate 13 is not threaded and allows the shaft of the fastening element 38 to be rotatable with respect thereto. To allow the table 40 to be rotated relative to the base plate 13, a pair of polyethylene bearings 44 and 45 are provided which generally encircle the threaded shaft 38 of the fastening element. In this manner, the bearings allow relative rotation of the table 40 to the base plate. However, upon tightening of the fastening element 38 relative to the table 40, the amount of compressive force or friction created between the bearings 44 and 45 can be increased to secure the table in fixed relationship to the base. This is accomplished after proper windage adjustment or left/right horizontal adjustment is made when the shooter's bench is in use.

To further support the shooter relative to the bench 10, a forearm support 50 is provided which includes a padded upper portion 51 which is secured in cantilevered relationship relative to the front edge 53 of the base plate 13 by projecting arms 54 and 55. The inner end portion of each of the arms 54 and 55 include openings 56 therethrough which are aligned with openings 57 in the base plate and through which bolts 58 extend. The bolts 58 are secured utilizing wing nuts 59.

As specifically shown in FIG. 1, the outer end portions of the arms 54 and 55 are downwardly inclined relative to the front edge 53 of the base plate. As the table 40 is also aligned so that its front edge 60 is aligned with the front edge 53 of the base plate, the forearm support will be aligned with the front edge thereof.

In view of the positioning of the inclined forearm support relative to the table 40, when a rifle is supported on the firearm support table 40, as is shown in dotted line in FIG. 1, the right forearm of a right handed shooter, or the left forearm of a left handed shooter, will be supported at a natural angle of inclination such that the wrist of the individual need not be curved in order to allow the shooter's hand to engage around the butt of the rifle adjacent the trigger. Thus, the trigger can be easily engaged without twisting or otherwise manipulating or bending the forearm or wrist relative to one another. The proper alignment of the forearm and wrist reduces tension in the muscles along the forearm thus steadying the individual's engagement with the firearm supported on the table 40. It should be noted that the shooter's bench of the present invention may be used by both left and right-handed shooters without adjustment.

To provide additional stabilization, one or more sandbags S may be placed upon the upper surface of the support table. The sandbags may be manipulated to provide a cradle for supporting the stock of the firearm during use. To assure adequate retention of the sandbags on the shooter's bench, the table 40 is preferably made of wood.

As previously noted, once the rifle has been aligned for height adjustment utilizing the sandbags placed upon the table 40, any change in windage correction may be made by loosening the fastening element 38 and allowing the table 40 to rotate relative to the base plate 13. Thereafter, the table may be resecured by tightening the fastening element 38 to place additional compressive force on the bearings 44 and 45.

When it is desired to transport the shooter's bench of the present invention, the various fasteners are easily manually manipulated and the components of the shooter's bench disassembled. A carrying case 60 is provided having a bottom compartment 61 and an upper cover 62. A handle 63 extends from one of the side walls of the lower compartment and is extendable through an opening 64 in the upper cover or lid 62. The components, once disassembled, are positioned within the lower compartment as is shown in FIG. 4 and thereafter the lid closed and locked utilizing the positioning of the handle 63 through the opening 64.

The invention is preferably formed of lightweight steel tubing forming the leg portions with the seats being made of plywood covered with a foam material and a synthetic leather material. The base plate 13 is preferably formed of an ⅛" steel plate and the table of plywood. In view of the materials utilized to construct the shooter's bench, the bench is lightweight and may be easily transported.

I claim:

1. A shooter's bench for supporting an individual shooting a firearm comprising, a stand, said stand including a base plate and a plurality of first legs depending from said base plate, said base plate having upper and lower surfaces, an armrest means, means for mounting said armrest means to said base plate so as to extend outwardly and incline downwardly relative thereto, a firearm support means, means for mounting said firearm support means to said stand and adjacent said upper surface of said base plate, a seat mounted to said stand in spaced relationship below said armrest means, and seat support means for mounting said seat to said first legs whereby the individual seated on said seat may lean against said armrest means to stabilize a firearm supported on said firearm support means.

2. The shooter's bench of claim 1, including a carrying case means, said carrying case means having a body portion and a closure member, said firearm support means and said stand being stored within said carrying case means when said shooter's bench is disassembled.

3. The shooter's bench of claim 1 in which said means to mount said armrest means includes extension members having inner and outer portions, said outer portion being downwardly inclined relative to said base plate, and hand manipulable fastening means for connecting said inner portions to said base plate and said outer portions to said armrest means.

4. The shooter's bench of claim 3 in which said first legs include first and second portions, said first portion being generally parallel to said base plate and hand manipulable means for connecting said base plate to said first portion of said first legs.

5. The shooter's bench of claim 1 in which said means for mounting said firearm support means to said stand includes means for rotatably mounting said firearm support means to said stand.

6. The shooter's bench of claim 5, including bearing means mounted between said firearm support means and said base plate.

7. The shooter's bench of claim 6, including means for tensioning said bearing means to retain said firearm support means in fixed relationship relative to said base plate.

8. The shooter's bench of claim 5 in which said seat support means includes first and second elements having first and second segments, and hand manipulated fastening means for securing said first segment to said legs and said seat, and said second segments extending downwardly to provide second legs for supporting said seat.

9. The shooter's bench of claim 8 in which said means to mount said armrest means includes extension members having inner and outer portions, said outer portion being downwardly inclined relative to said base plate, and hand manipulable fastening means for connecting said inner portions to said base plate and said outer portions to said armrest means.

10. A shooter's bench for supporting an individual shooting a firearm comprising, a stand, said stand including a base plate and a plurality of first legs depending from said base plate, said base plate having upper and lower surfaces, an armrest means, means for mounting said armrest means to said base plate so as to extend outwardly and incline downwardly relative thereto, a firearm support means, means for mounting said firearm support means to said stand and adjacent said upper surface of said base plate, a seat in spaced relationship below said armrest means, and second legs for supporting said seat whereby the individual seated on said seat may lean against said armrest means to stabilize a firearm supported on said firearm support means.

11. The shooter's bench of claim 10 in which said means to mount said armrest means includes extension members having inner and outer portions, said outer portion being downwardly inclined relative to said base plate, and hand manipulable fastening means for connecting said inner portions to said base plate and said outer portions to said armrest means.

12. The shooter's bench of claim 10, including a carrying case means, said carrying case means having a body portion and a closure member, said firearm support means and said stand being sorted within said carrying case means when said shooter's bench is disassembled.

13. The shooter's bench of claim 10 in which said means for mounting said firearm support means to said stand includes means for rotatably mounting said firearm support means to said stand.

14. The shooter's bench of claim 13, including bearing means mounted between said firearm support means and said base plate.

15. The shooter's bench of claim 14, including means for tensioning said bearing means to retain said firearm support means in fixed relationship relative to said base plate.

16. The shooter's bench of claim 15 in which said means to mount said armrest means includes extension members having inner and outer portions, said outer portion being downwardly inclined relative to said base plate, and hand manipulable fastening means for connecting said inner portions to said base plate and said outer portions to said armrest means.

* * * * *